US009409582B2

(12) United States Patent
Pavčnik

(10) Patent No.: US 9,409,582 B2
(45) Date of Patent: Aug. 9, 2016

(54) LINE DISTRIBUTOR, PREFERABLY FOR ANTI-NOISE DEVICE FOR RAIL BRAKES

(71) Applicant: Bojan Pavčnik, Velenje (SI)

(72) Inventor: Bojan Pavčnik, Velenje (SI)

( * ) Notice: Subject to any disclaimer, the term of this patent is extended or adjusted under 35 U.S.C. 154(b) by 4 days.

(21) Appl. No.: 14/360,639

(22) PCT Filed: Jan. 24, 2013

(86) PCT No.: PCT/SI2013/000005
§ 371 (c)(1),
(2) Date: May 26, 2014

(87) PCT Pub. No.: WO2013/112108
PCT Pub. Date: Aug. 1, 2013

(65) Prior Publication Data

US 2014/0318897 A1 Oct. 30, 2014

(30) Foreign Application Priority Data

Jan. 28, 2012 (SI) ..... P-201200024

(51) Int. Cl.
*B61K 3/00* (2006.01)

(52) U.S. Cl.
CPC ..... *B61K 3/00* (2013.01)

(58) Field of Classification Search
CPC ..... B61K 3/00
USPC ..... 184/3.1, 3.2
See application file for complete search history.

(56) References Cited

U.S. PATENT DOCUMENTS 1,885,726 A * 11/1932 Isabella ..... B61K 3/02 184/3.2
1,940,527 A * 12/1933 Bolt ..... B61K 3/00 184/3.1
1,967,474 A * 7/1934 Hoofer ..... F16N 13/06 184/3.1
3,838,646 A * 10/1974 Smith ..... B61B 1/005 104/26.2
4,520,901 A * 6/1985 Borup ..... B61K 3/00 184/15.3
4,711,320 A * 12/1987 Dombroski ..... B61K 3/00 184/3.2
6,585,085 B1 * 7/2003 Kumar ..... B61K 3/00 184/3.2
7,258,201 B2 * 8/2007 Urmson, Jr. ..... B61K 3/00 184/3.1

(Continued)

FOREIGN PATENT DOCUMENTS

DE 490195 C 1/1930
GB 775335 A1 5/1957
GB 2004955 A1 4/1979

*Primary Examiner* — William E Dondero
*Assistant Examiner* — Mark K Buse
(74) *Attorney, Agent, or Firm* — Robert Platt Bell

(57) ABSTRACT

The time lag between start and application of a medium onto the rail vehicle wheel's flank is solved by line distributor for anti-noise medium for rail brakes wherein the line distributor is positioned directly next to rails to provide for accurate dosage. Applicator guides are rounded, preferably elliptical, or essentially circular cross-section so the edges of damaged wheels do not transfer shocks onto the device. The medium is spread around the wheel's flank and it does not necessarily lower the friction coefficient—it may even increase of said friction coefficient. Said lubricant is preferably very complex Composite Heavy Fluid Compound (CHFC).

11 Claims, 2 Drawing Sheets

(56) References Cited

U.S. PATENT DOCUMENTS

| | | | | |
|---|---|---|---|---|
| 7,513,335 | B2 * | 4/2009 | Kumar | B61K 3/00 184/3.1 |
| 2003/0010571 | A1 * | 1/2003 | Kostelny-Vogts | B61K 3/00 184/3.1 |
| 2004/0031647 | A1 * | 2/2004 | Leslie | B61K 3/00 184/3.1 |
| 2004/0238281 | A1 * | 12/2004 | Kumar | B61K 3/00 184/3.1 |
| 2008/0223661 | A1 * | 9/2008 | Singleton | B61K 3/00 184/3.1 |
| 2009/0000869 | A1 * | 1/2009 | Holland | B61K 3/00 184/3.1 |
| 2009/0000870 | A1 * | 1/2009 | Holland | B61K 3/00 184/3.1 |
| 2011/0259670 | A1 * | 10/2011 | Amilien | B05B 1/24 184/6.22 |

* cited by examiner

LINE DISTRIBUTOR, PREFERABLY FOR ANTI-NOISE DEVICE FOR RAIL BRAKES

CROSS-REFERENCE TO RELATED APPLICATIONS

The present application is a 371 National Phase filing of PCT/SI2013/00005, filed on Jan. 24, 2013, which in turn claims priority from Slovenian Patent Application P-201200024, filed on Jan. 28, 2012, both of which are incorporated herein by reference.

FIELD OF THE INVENTION

The present invention relates to applying anti-noise compound to the flanks of rail vehicles. In particular, the present invention is directed toward distribution of very complex Composite Heavy Fluid Compound (CHFC) as an anti-noise compound for rail vehicles.

BACKGROUND OF THE INVENTION

State of the art features of many distribution devices for distribution of very complex Composite Heavy Fluid Compound (CHFC) are related to the nature of distribution and due to the physical size of the device, which is usually remote in relation to point of application and dosage of a medium. The remoteness of the device means several seconds are needed for the material to arrive through the distribution network to the point of application on the wheel, which is not acceptable. Acceptable times are on the order of up to 250 ms.

In addition the Prior Art guides of the applicator used by state of the art distributors are flat, and this can lead to damage of the wheel surface.

SUMMARY OF THE INVENTION

The problem to be solved by this invention is the time shift of distribution of very complex Composite Heavy Fluid Compound (CHFC) from exit from the pump to point of application as well as the hindering performance and increase in maintenance costs by passage of railway cars along the applicator. For purposes of this patent application the applicator is a system enabling dosage of anti-noise compounds, and type of this applicator for the purposes of this application is called a line distributor.

The above-referenced technical problem is solved by a line distributor, preferably for anti-noise medium for rail brakes wherein the line distributor is positioned directly next to rails to provide for accurate dosage in real-time and in required and desired quantity. In such a case, the dosage tubes are reduced to the length enabling correct operation of an applicator.

The device is preferably used for application of an anti-noise medium onto the wheels of rail vehicles.

In addition, flat guides of the applicator are replaced with guides with rounded, preferably essentially elliptical, more preferably essentially circular cross section, so the edges of damaged wheels do not transfer shocks onto the device.

The distributors in general are devices used for distribution and dosage of a medium onto the wheel of the rail vehicle which is approaching a part of the rails with additional friction between wheel rim and rail or some other device such as a rail switch, rail brake, lead rail or some other device. The medium for purposes of this application in this case is a compound spread around the wheel and it does not necessarily lower the friction coefficient—in fact it may even increase said friction coefficient. Said medium according to this invention is preferably very complex Composite Heavy Fluid Compound (CHFC).

In this patent application's preferred embodiment the line distributor is used for application of the medium for rail brakes which means that the medium increases the friction coefficient while decreasing noise between rail brake and wheel rim during braking.

The line distributor is arranged along the rail in part where the medium should be applied onto the wheel's flanks, and is comprised of a number of mini pumps, and is driven by means of electric motor, pneumatic motor, wheels of rail vehicles or by any other means, said line distributor providing the wheels with medium, preferably very complex Composite Heavy Fluid Compound (CHFC).

The advantage of elliptic, preferably round guides (in this patent application the expression "guide tube" expression is also used) is to provide for "softer" (i.e. less bumpy) transfer of wheels through the distributor, as well as providing for decrease of waste of material into gravel bed, while material stuck on the top of said guide provides in part of wheels sides and lower wear of guide tube.

BRIEF DESCRIPTION OF THE DRAWINGS

Below this patent application is further described with help of figures whereas these figures form part of this patent application, and describe.

DETAILED DESCRIPTION OF THE INVENTION

Figure 1:
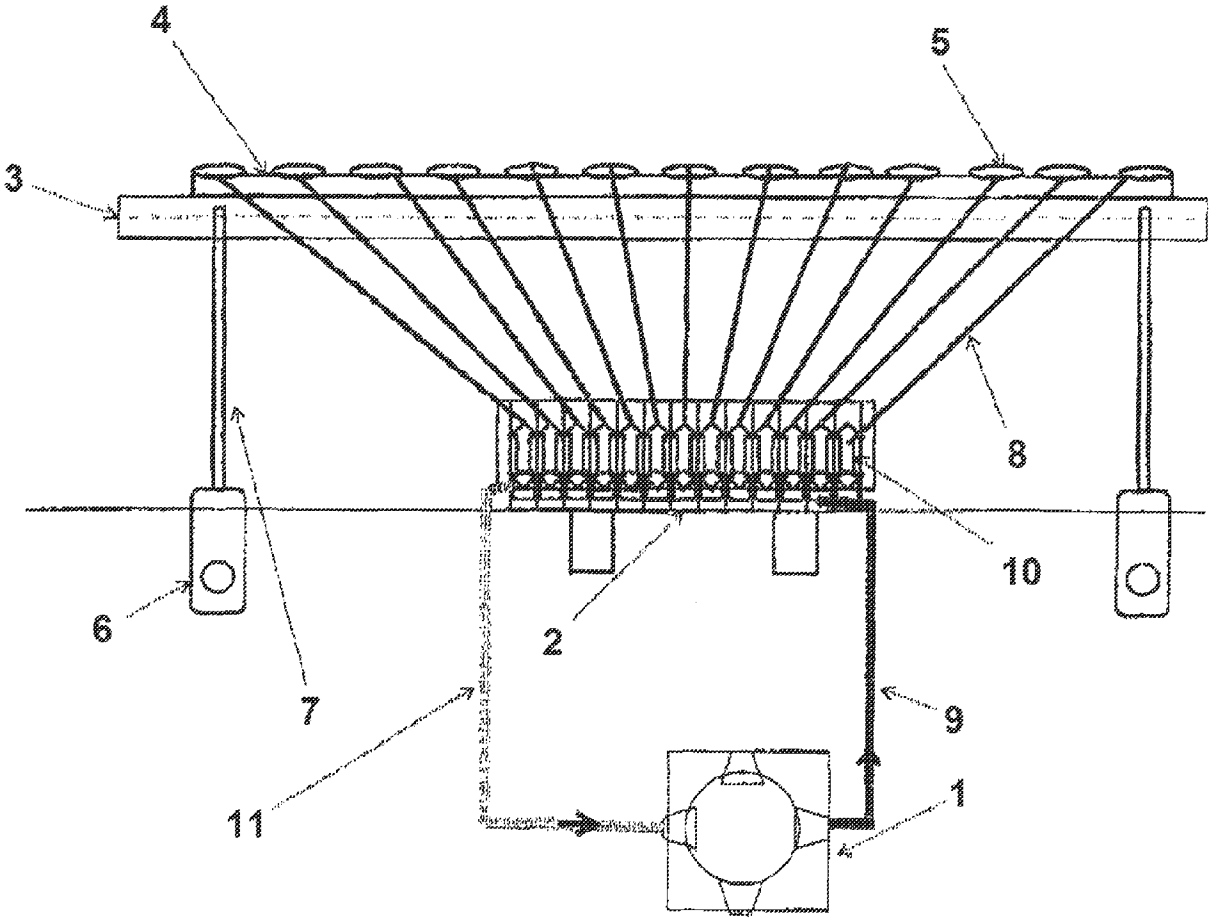
FIG. 1 shows main drive train 1, auxiliary drive train 2, guide tube 3, brush 4, dosage nozzle 5, applicator guide 6, spring bracket 7, dosage tubes 8, inlet tube 9, mini pump 10, return tube 11.
Figure 2:
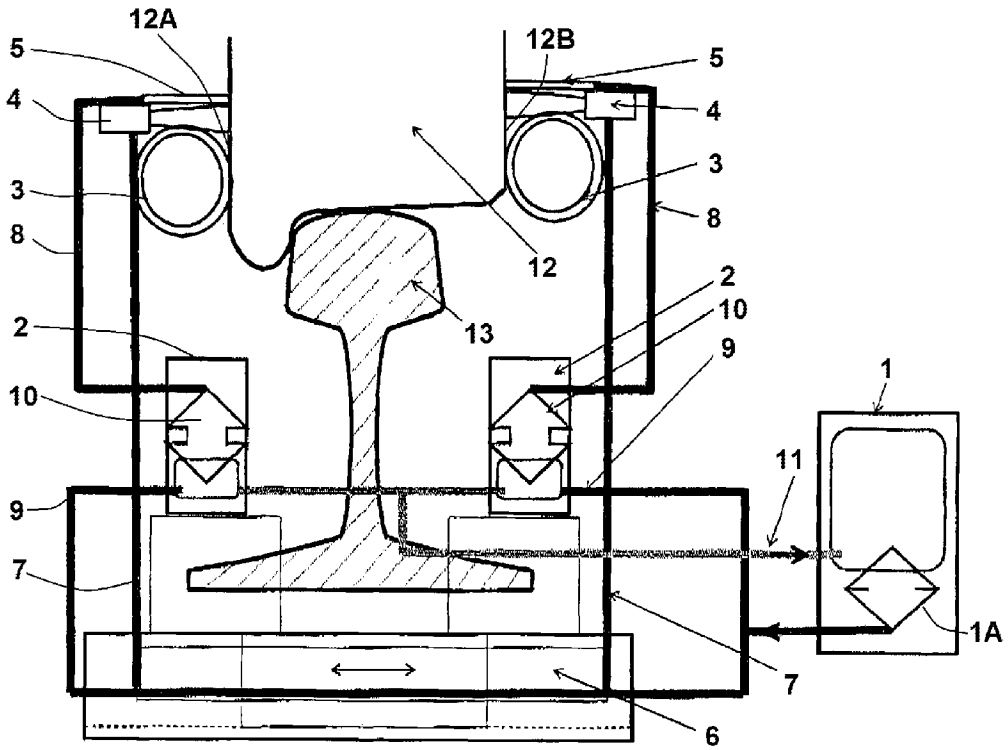
FIG. 2 shows main drive train 1, auxiliary drive train 2, guide tube 3, brush 4, dosage nozzles 5, applicator guide 6, spring bracket 7, dosage tubes 8, inlet tube 9, mini pump 10, return tube 11, wheel 12, rail 13.

In a preferred embodiment the device is comprised of main drive train 1 (in this application the drive train describes a device or plurality thereof, usually comprised of pumps 1A, supplies tubes, control and regulation and other similar devices providing for standalone operation of fluid supply at predetermined flow rate and/or pump head) which supplies a medium, preferably very complex Composite Heavy Fluid Compound (CHFC), to auxiliary drive train 2 from a container. The main drive train 1 is comprised preferably of a pump 1A with sufficient pump head and flow rate so the auxiliary drive train 2 is supplied with sufficient amount of medium to be applied onto the rails and is switched on and off when needed (when supplying of said rails by medium is foreseen by anticipated passing of the wheel 12). The auxiliary drive train 2 is connected to main drive train 1 by means of inlet tube 9 for inflow of the medium, and return tube 11 for return of excess medium.

The auxiliary drive train 2 comprises mini pump 10 or plurality thereof. The auxiliary drive train 2 is activated by proximity of wheel 12 in such a way that mini pump 10 or plurality thereof is activated, and medium is applied to passing the outer flank 12B and inner flank 12A of wheel 12 through dosage nozzle 5 or plurality thereof. Said mini pump 10 may be therefore on need-to basis when the wheel 12 enters the distributor area. During this time the mini pump 10 pumps said medium from amount supplied by the main drive train 1. Dosage nozzle 5 or plurality thereof are connected to mini pump 10 or plurality thereof by means of dosage tubes 8.

At the same time the brush 4 is switched on said brush 4 during operation of the auxiliary drive train 2 or mini pumps 10 with oscillations around neutral point further spreads the medium across the surface of the outer flank 12A and inner flank 12B of wheel 12. This neutral point is essentially equilibrium point of said brush 4 in which it settles after it has ceased with oscillation, or it can be any other point being center of said oscillating movement.

In preferred embodiment the dosage nozzles 5 are connected by means of dosage tubes 8 in such a way that each mini pump 10 supplies one dosage nozzle 5. In addition, there is possibility that a single mini pump 10 supplies a plurality of dosage nozzles 5, or alternatively that a plurality of mini pumps 10 supplies a single dosage nozzle 5, or combination of both. The dosage nozzle 5 is enlarged at the exit so a wider application of said medium is enabled. They are also positioned on the top of applicator so they are least exposed to dirt and other impurities and enable the most efficient applications of said medium onto the outer flank 12A and inner flank 12B of wheel 12.

The applicator guide 6 serves for transversal movement of guide tube 3, the spring bracket 7 compensates the shocks arising from the outer flank 12A and inner flank 12B of wheel 12 hitting the guide tube 3. The applicator guide 6 therefore provides for transversal adjustment of applicator to the wheels 12 of the rail vehicles while the spring bracket 7 provides for damping during entry into said applicator.

A preferred embodiment features the guide tube 3 added to the device, preferably in pairs, said guide tube 3 providing guiding of wheel 12 on rail 13 in such a way that wheels 12, which may be damaged, do not transfer shocks to the device according to this invention as such shocks could damage said device.

As the guide tubes 3 have an elliptic cross section preferably round (circular), the cross-section of such guide tubes 3 is elastically adjusting to possible uneven running of said wheel 12 which in turn causes said wheel 12 to run smoother and with less noise between said guide tubes 3.

At the same time guide tube 3 touches, due to its form, the wheel in a line providing for barrier between the gravel bed and the wheel 12 forming an obstacle between the wheel 12 and the gravel bed, preventing run-off of said medium from said wheel onto said gravel bed. Further, the guide tube 3 provides for further spreading of said medium onto said wheel 12. Last but not least due to small contact surface (thin contact line) the friction between the wheel and the guide tube 3 is decreased.

The dosage nozzle 5 can feature an elongated cross-section. In a preferred embodiment it is essentially elliptic in cross section, however it can also be essentially rectangular in such a way that the long axis of ellipse or long side of said rectangle is approximately parallel to movement of said rail vehicle. Such a form of the dosage nozzle 5 results in thicker or larger trail, this having advantageous effect on reduction of friction.

While the preferred embodiment and various alternative embodiments of the invention have been disclosed and described in detail herein, it may be apparent to those skilled in the art that various changes in form and detail may be made therein without departing from the spirit and scope thereof.

The invention claimed is:

1. A line distributor, for distributing a non-lubricating anti-noise medium for rail brakes, comprising:

a main drive train (1) including at least one motorized pump, for supplying said non-lubricating anti-noise medium under pressure;

an inlet tube, coupled to the main drive train, for transporting said non-lubricating anti-noise medium under pressure to an area proximate a rail;

at least one motorized mini pump (10), coupled to the inlet tube and located proximate to the rail, said at least one motorized mini pump (10) pumps said non-lubricating anti-noise medium from an amount supplied by a main drive train (1) through the inlet tube;

at least one dosage tube (8), coupled to the at least one motorized mini pump, for transporting said non-lubricating anti-noise medium from the at least one motorized mini pump to an area located adjacent the rail; and at least one dosage nozzle (5) coupled to a corresponding one of said at least one dosage tube (8) distributing said non-lubricating anti-noise medium onto at least one flank side of a wheel (12), characterized in that said amount of said non-lubricating anti-noise medium is supplied selectively and intermittently in response to passing by of said wheel (12), characterized in that said at least one mini pump (10) is selectively switched on when said wheel (12) enters a line distributor area, characterized in that it further comprises at least one guide tube (3) mounted so as to contact at least one corresponding flank side of the wheel, characterized in that it further comprises at least one brush (4) engaging at least one flank side of the wheel and oscillating around a neutral point during operation of said mini pump (10) to evenly spread said non-lubricating anti-noise medium on the at least one flank side of the wheel, further comprising:

an auxiliary drive train (2) connected to said main drive train (1), inlet tube (9) and return tube (11), said at least one mini pump (10) in the auxiliary drive train (2), said at least one dosage nozzle (5) connected to said at least one mini pump (10) with at least one dosage tube (8) and said brush (4), wherein the non-lubricating anti-noise compound is continually circulated from the auxiliary drive train to the main drive train to prevent the non-lubricating anti-noise compound from clogging.

2. The line distributor according to claim 1, characterized in that it comprises an applicator guide (6), said applicator guide (6) allowing transversal adjustment of applicator (6) to wheels (12) of a rail vehicle to compensate for lateral movement of the wheels of the rail vehicle as is passes through the line distributor.

3. The line distributor according to claim 2, characterized in that it comprises spring bracket (7) providing for damping of shocks during entry of said wheel (12) into said applicator (6) as said wheel contacts the guide tube.

4. The line distributor according to claim 3, characterized in that said at least one nozzle (5) features an elongated cross section with a longer axis essentially parallel to direction of movement of said rail vehicle applying said non-lubricating anti-noise medium on at least one flank side of the wheel.

5. The line distributor according to claim 4, characterized in that said elongated cross-section of said at least one nozzle (5) is essentially elliptic.

6. The line distributor according to claim 4, characterized in that said elongated cross-section of said at least one nozzle (5) is essentially rectangular.

7. The line distributor according to claim 1, characterized in that the at least one guide tube (3) comprises a pair of guide tubes (3) mounted on either side of the rail, each of the pair of guide tubes engaging a corresponding flank side of the wheel for guiding of said wheel (12) through the line distributor.

8. The line distributor according to claim 7, wherein the pair of guide tubes are essentially elliptic in cross-section.

9. The line distributor according to claim 7, wherein the pair of guide tubes are essentially circular in cross-section.

10. The line distributor of claim 1, wherein the non-lubricating anti-noise medium comprises a Composite Heavy Fluid Compound.

11. A line distributor, for distributing a non-lubricating anti-noise medium for rail brakes, comprising:

a main drive train (1) including at least one motorized pump, for supplying said non-lubricating anti-noise medium under pressure;

an inlet tube (9), coupled to the main drive train, for transporting said non-lubricating anti-noise medium under pressure to an area proximate a rail;

at least one motorized mini pump (10), coupled to the inlet tube (9) and located proximate to the rail, said at least one motorized mini pump (10) pumps said non-lubricating anti-noise medium from an amount supplied by a main drive train (1) through the inlet tube (9);

at least one dosage tube (8), coupled to the at least one motorized mini pump, for transporting said non-lubricating anti-noise medium from the at least one motorized mini pump to an area located adjacent the rail; and at least one dosage nozzle (5) coupled to a corresponding one of said at least one dosage tube (8) distributing said non-lubricating anti-noise medium onto at least one flank side of a wheel (12), characterized in that said amount of said non-lubricating anti-noise medium is supplied selectively and intermittently in response to passing by of said wheel (12), characterized in that it further comprises at least one brush (4) engaging at least one flank side of the wheel and oscillating around a neutral point during operation of said mini pump (10) to evenly spread said non-lubricating anti-noise medium on the at least one flank side of the wheel, further comprising:

an auxiliary drive train (2) connected to said main drive train (1), inlet tube (9) and return tube (11), said at least one mini pump (10) in the auxiliary drive train (2), said at least one dosage nozzle (5) connected to said at least one mini pump (10) with at least one dosage tube (8) and said brush (4), wherein the non-lubricating anti-noise compound is continually circulated from the auxiliary drive train to the main drive train to prevent the non-lubricating anti-noise compound from clogging.

* * * * *